US008628398B2

(12) United States Patent
Ellis

(10) Patent No.: US 8,628,398 B2
(45) Date of Patent: Jan. 14, 2014

(54) GAMING APPARATUS AND SYSTEMS

(75) Inventor: Benjamin James Ellis, Wentworthville (AU)

(73) Assignee: Dynamite Service Pty, Limited, Neutral Bay (AU)

( * ) Notice: Subject to any disclaimer, the term of this patent is extended or adjusted under 35 U.S.C. 154(b) by 376 days.

(21) Appl. No.: 12/299,100

(22) PCT Filed: Apr. 30, 2007

(86) PCT No.: PCT/AU2007/000547
§ 371 (c)(1),
(2), (4) Date: Jan. 20, 2009

(87) PCT Pub. No.: WO2007/128033
PCT Pub. Date: Nov. 15, 2007

(65) Prior Publication Data

US 2009/0203422 A1 Aug. 13, 2009

(30) Foreign Application Priority Data

May 1, 2006 (AU) ..... 2006902249

(51) Int. Cl.
*A63F 9/24* (2006.01)

(52) U.S. Cl.
USPC ..... 463/20

(58) Field of Classification Search
USPC ..... 463/20
See application file for complete search history.

(56) References Cited

U.S. PATENT DOCUMENTS

| | | | | |
|---|---|---|---|---|
| 5,570,885 | A * | 11/1996 | Ornstein | 463/27 |
| 2002/0183105 | A1 * | 12/2002 | Cannon et al. | 463/16 |
| 2004/0043815 | A1 * | 3/2004 | Kaminkow | 463/25 |
| 2006/0040735 | A1 * | 2/2006 | Baerlocher | 463/26 |
| 2006/0121972 | A1 * | 6/2006 | Walker et al. | 463/16 |
| 2007/0232379 | A1 * | 10/2007 | Falciglia | 463/19 |

FOREIGN PATENT DOCUMENTS

| | | | |
|---|---|---|---|
| WO | WO 01/84515 | A2 | 11/2001 |
| WO | WO 0184515 | A2 * | 11/2001 |

* cited by examiner

*Primary Examiner* — William D Coleman
*Assistant Examiner* — Christine Enad
(74) *Attorney, Agent, or Firm* — Henricks, Slavin & Holmes, LLP

(57) ABSTRACT

Gaming apparatus, e.g. an Electronic Gaming Machine (EGM) (1), includes a controller (2) for implementing e.g. slot-machine games, casino-type games or other betting game. The EGM (1) displays a gaming image on a display (6), e.g. virtual symbol reels or card hands, and receives player instructions via an input (7), e.g. to spin the reels or manage the cards. The EGM (1) includes a means for playing a number of games simultaneously and for receiving bets, and means for monitoring game events over a number of concurrent plays of the game. It also includes means for placing one or more series bets on the occurrence of game events over a series of concurrent game plays, and series win means for determining that a player has won a series bet based on the bet placed and the monitored events. The monitored game events may be prize events, e.g. the winning of a cash amount, or feature events, e.g. the triggering of a bonus round, free game or the like. The series bet win may be a prize, e.g. a jackpot, or may be some other valuable feature.

28 Claims, 3 Drawing Sheets

GAMING APPARATUS AND SYSTEMS

RELATED APPLICATIONS

This patent application claims benefit of International Application No. PCT/AU2007/000547, filed 30 Apr., 2007 entitled Gaming Apparatus And Systems, which in turn claims priority from Australian Provisional Patent Application No. 2006902249 filed on 1 May 2006 entitled Gaming Apparatus And Systems, the contents of which are incorporated herein in their entirety by reference.

The present invention relates to gaming apparatus and systems. It relates for example to electronic gaming machines and to networked gaming systems. It relates for example to Internet or Intranet based gaming systems.

Gaming machines have been a popular form of entertainment for many years. This popularity has been enhanced with the advent of electronic gaming machines and also computer-based gaming systems, such as are provided over the Internet.

Many different types of game are playable. They include for example standard slot-machine type games with spinning reels, and casino-type games. They include games such as poker, keno, bingo, blackjack, roulette, pachinko, Sic-Bo and many others.

A user will typically place a bet, press a button or pull a lever to begin a game, and will win or lose based upon for example mechanical reel stops and/or a gaming machine's play algorithms and random number generators.

An aim of the present invention is to provide gaming apparatus having novel features for enhancing gameplay interest.

Viewed from one aspect, the present invention provides gaming apparatus including: game means for allowing a number of games to be played simultaneously, including means for placing bets on each of the games and for determining win outcomes based on the playing of each of the games; monitoring means for monitoring the occurrence of one or more game events during a series of concurrent game plays; series betting means for allowing a user to place a series bet on the occurrence of one or more game events over said series of concurrent game plays; and series win means for determining a series win event based on a placed series bet and on the occurrence of said one or more game events.

Some embodiments of the present invention allow a player to play a regular game, such as a slot game or the like, and to win normally based on the outcome of a play of the game. Also, however, the present invention allows a player to place a bet on a game event or events occurring over a number of concurrent plays of the game. This helps to increase player interaction and player interest in a game.

A monitored game event may be any event associated with the play of a game. It may be a prize event, e.g. the winning of money or play credits or some other prize, or could be a feature event, e.g. an event that provides some sort of advantage or interest to a player.

The series bet may relate to a specific game event, e.g. prize event or feature event, or may relate to any of a number of game events, e.g. to any of a number of prize events and/or feature events. It may relate for example to the number of prize and/or feature events that occur in a series of play, to a total value related to the events that occur, e.g. total winnings, or to specific events or combinations of events.

For example, a player may play a regular game of slot reels six times, and may win or lose in a standard manner on each individual play, but may also bet that he or she will receive four prize wins or four feature triggers over the six plays, and will receive an appropriate payout if this is achieved. In another example, a player could bet on no wins occurring over all or some of the series of plays, so that if they lose out on some or all of their standard bets, they may be compensated by winning an associated series bet.

A monitored prize event may for example relate to a prize of a particular amount or a prize over or under a set amount, or could relate to a prize win under a particular circumstance, e.g. a flush or the like at poker or a set combination of slot machine reel symbols. It could also relate to a jackpot prize.

A monitored feature event could relate to the occurrence of a particular play element, such as a wild card or wild symbol. It could relate to a free play scenario, a respin, or a game play that returns higher than usual wins, e.g. through the provision of better odds or higher winnings. It may be a "second-screen" type feature, which may involve a play that is extraneous to a main or basic game.

The apparatus may include selection means for allowing a player to select a series bet from a number of possible series bets. The selection means may include a look-up table of possible series bets, together with odds for determining returns on the bets, as well as means for displaying the possible series bets and means for allowing a user to select the series bets on which they wish to bet. The stake laid on each series bet may be set by the apparatus or may be set by the player. A table of series bets from which a user may select may be provided on a main gaming screen or on secondary screens accessible from a main screen, e.g. through the activation of a series bet button.

The apparatus may display details of the progress of a series bet. It may for example monitor and display the number of games remaining in a series bet and the results so far for the series bet, e.g. how many events so far achieved and the like. This may be provided on a main gaming screen or on a secondary screen accessible from a main screen.

The number of plays in a series bet may be set automatically by the gaming apparatus, e.g. to a set number of games or to a randomly determined number of games. The number of plays may also be set manually by the player.

The series of concurrent game plays involves a number of games that are shown and played at the same time.

The series bet win event may be of any suitable type, and, e.g. may be the winning of a prize amount or a particularly valuable game feature. The prize amount may be fixed or may depend upon a series bet amount. The series bet win event may be a jackpot event, e.g. the winning of a jackpot or the winning of the chance to play a jackpot, e.g. a jackpot spin. The jackpot could be a fixed or progressive jackpot, and could be a linked jackpot that may be won by a number of machines.

The series betting feature may be optional or compulsory. A player may pay for a series bet, e.g. through a side bet or secondary bet. A player may also receive a series bet automatically, e.g. dependent on gameplay, e.g. they may trigger a series bet as a feature, e.g. when they play a maximum bet on a game.

A series bet may relate to a number of plays of the same game or to plays of a number of different games, e.g. a combination of poker and slots games. Games may also be played on different gaming machines, e.g. in a gaming system where player data can be transferred between machines.

The apparatus may include means for fixing or limiting the play parameters of the basic game or games when a series bet is placed. This may ensure that when a game includes the series bet it is mathematically viable and consistent. For example, the playing of a series game may require a fixed bet on the underlying basic games that are played in the series, e.g. a fixed number of pay lines may be played in a slot reel game.

The present invention may be applied to gaming apparatus that plays any suitable game or games, e.g. slot-machine-type games or casino-type games. The present invention could relate to poker, keno, blackjack, bingo, roulette, Sic-Bo, pachinko, and many other betting games.

The present invention may be applied to any suitable type of gaming system or platform. It can apply to stand-alone gaming apparatus, e.g. electronic gaming machines, such as video gaming machines, e.g. video slot machines, and to gaming devices that are linked together, e.g. electronic gaming machines that are linked via a network such as an intranet. It can apply to gaming systems provided through computing or other electronic devices, e.g. personal computers, PDAs, mobile telephones, digital televisions, and the like, e.g. over the Internet or other communications networks.

The present invention may be applied to gaming apparatus that is mechanical in nature, e.g. spinning reels, and which includes electronic means for supplementing and/or reflecting the mechanical game play or an electronic management system. For example, the present invention may be applied to a mechanical "stepper" slot game that is coupled with an overhead video screen that may display the mechanical reels and/or may provide extra functionality, e.g. feature games, linked jackpots, and the like.

When a gaming device is part of a network, e.g. one of a series of linked gaming machines, series bets could be based on the occurrence of plays on other linked devices as well, e.g. a player may bet on the occurrence of game events during their own play and during the plays of others, e.g. during the next play or set of plays that everyone or a subset of other players makes.

In networked games, the apparatus may include a central control/server for conducting games and for managing the accounting and the like, and a number of remote terminals/clients that provide user input and display mechanisms. The control of the game may be carried out at the central control or at the remote terminals, or may be split between the two.

The present invention extends to central controls/servers and remote terminals/clients that are configured to carry out series betting features of the present invention.

Viewed from another aspect, the present invention provides a gaming system including: game means for allowing a number of games to be played simultaneously, including means for placing bets on each of the games and for determining win outcomes based on the playing of each of the games; monitoring means for monitoring the occurrence of one or more game events during a series of concurrent game plays; series betting means for allowing a user to place a series bet on the occurrence of one or more game events over said series of concurrent game plays; and series win means for determining a series win event based on a placed series bet and on the occurrence of said one or more game events.

Preferably, the system includes a central control for running a gaming algorithm, and a plurality of remote clients in communication with the central control over a communications network, the remote clients including displays for displaying gaming screens and inputs for allowing player interaction with the central control.

Viewed from another aspect, the present invention provides a method of operating gaming apparatus, the method including the steps of: running a number of games simultaneously on said apparatus and receiving a bet relating to each of the games; monitoring the occurrence of one or more game events during a series of concurrent game plays; allowing a user to place a series bet on the occurrence of one or more game event over said series of concurrent game plays; and determining a series win event based on a placed series bet and on the occurrence of said one or more game events.

Viewed from a further aspect, the present invention provides gaming software including: a play component for allowing a number of games to be played simultaneously, including for placing a bet on each of the games and for determining win outcomes based on the playing of each of the games; a monitoring component for monitoring the occurrence of one or more game events during a series of concurrent game plays; a series bet component for allowing a user to place a series bet on the occurrence of one or more game events over said series of game concurrent game plays; and a series win component for determining a series win event based on a placed series bet and on the occurrence of said one or more game events.

The present invention also extends to gaming/computer software products, including a recording media on which the above-mentioned software/program code is recorded.

Viewed from another aspect, the present invention provides gaming apparatus including: a gaming device for running a number of games simultaneously and receiving bets relating to each of the games; an event monitor for monitoring the occurrence of a game event over a number of concurrent game plays; and a series bet selector for allowing a user to select a series bet relating to the occurrence of at least one game event over a number of concurrent game plays.

Viewed from a further aspect, the present invention provides an electronic game in which a bet is placed, game events occur and wins are returned, wherein said game events are monitored and a user is able to bet upon the occurrence of one or more game events over a number of concurrent game plays.

Embodiments of the present invention will now be described, by way of example only, with reference to the accompanying drawings. It is to be understood that the particularity of the drawings does not supersede the generality of the preceding description of the invention.

Figure 1:
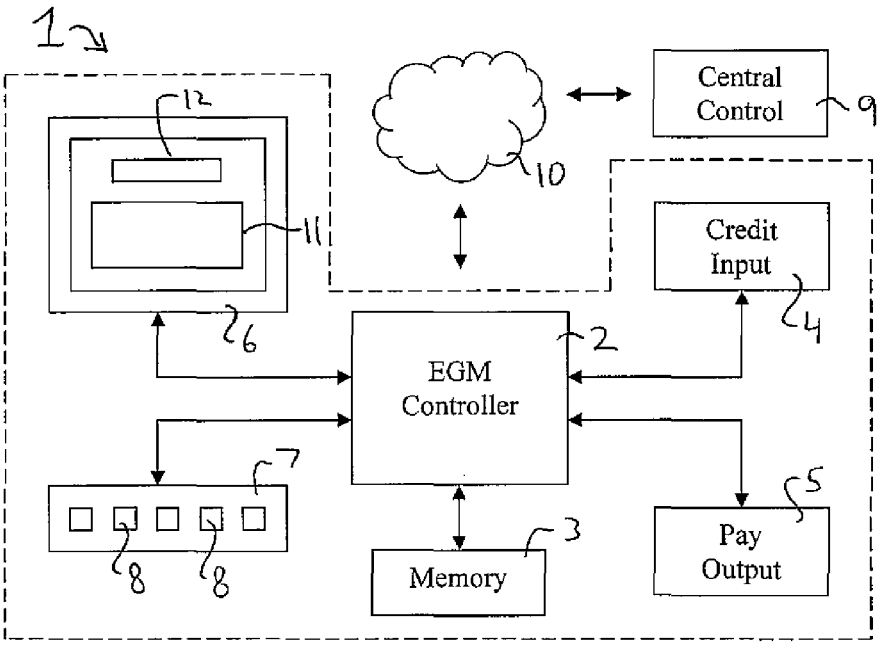
FIG. 1 is a block diagram of gaming apparatus according to an embodiment of the present invention.

Referring to FIG. 1, gaming apparatus, which in this case takes the form of an electronic gaming machine (EGM) 1, includes various components, such as a controller 2 for controlling the operation of the EGM 1 and the games run on it, memory 3 for storing programs and data used by the controller 2, a credit input 4 for receiving monies, e.g. coins, tokens and/or electronic credits, e.g. stored on a player's identification/data storage card, a win output 5 for paying out winnings, e.g. as coins, tokens or electronic money, e.g. by updating a player's card, a display 6 for displaying game screens, and user inputs 7 for allowing user interaction. The user inputs 7 may include buttons 8, which may be provided as part of a touchscreen of the display 6 and/or may be separate physical buttons.

The EGM 1 may be a stand-alone machine. It may also be networked with other EGMs and/or a control centre 9 via a suitable communications network 10, such as a LAN and/or WAN. This may for example allow for the play of networked (e.g. intranet or Internet) games, such as a linked jackpot.

In use, the EGM 1 displays an initial gaming screen on the display 6. A player inserts coins, tokens or a card into the credit input 4, and presses a button 8 to initiate play. How matters then proceed will depend on the type of game being played. For example, in a slot machine-type game, the EGM 1 will display virtual reels of symbols, and will spin and stop these reels in various win and lose symbol combinations on a pay line in accordance with stored gaming algorithms and random number generators. Alternatively, in a card-type game, a player will manage cards, e.g. receive a number of cards with which to play for a winning hand.

The player may interact via the display 6 and user inputs 7, so as to spin or hold reels, or to obtain and throw away cards and the like.

Whatever game is played, a common element will be win events, e.g. the pay of a prize when a particular symbol or card combination occurs.

Also, in order to increase interest, a game will often include bonus or feature events that may or may not relate directly to the game being played, and that generally provide an advantage of some sort. These bonus or feature events may include for example one or more free games, a respin (similar to a free game but with one or more reels held), or the chance to play for higher returns, e.g. higher payouts, better odds or the like. The bonus feature may relate to a wild feature, such as a wild reel symbol or card that can represent more than one type of reel symbol or card, and so can increase the chances of achieving a winning combination or the like. The bonus features may be provided in the main game or as "second screen" features that display on a new screen, and may be extraneous to the basic game. Bonus features are generally luck-based, but could be skills-based. They could for example allow a player to purchase an extra wild card in a draw poker skill game.

These win and feature events can be arranged to occur in many different ways, e.g. randomly or under a particular set of circumstances, e.g. based on a play outcome, e.g. triggered by a set reel symbol or card combination.

In accordance with one embodiment of the present invention, the EGM 1 includes a series betting feature, which allows a player to bet on the occurrence of one or more game events occurring over a number of concurrent plays of the game. The EGM 1 may for example allow a player to place one or more secondary bets on the outcome of a series of concurrent games, such that a player will win a prize or other valuable feature if the events that are bet upon occur. This can then provide a user with a greater choice of bets and a higher degree of game interaction and interest.

Thus, the EGM 1 may include game means for allowing a number of games to be played simultaneously, monitoring means for monitoring the occurrence of one or more game events during a series of concurrent game plays, series bet means for allowing a user to place a series bet on the occurrence of one or more game events over said series of concurrent game plays; and series win means for determining a series win event based on a placed series bet and on the occurrence of said one or more game events. These means may be provided through the EGM controller 2 and memory 3 and/or through the central control 9.

The EGM 1 may include selection means for selecting the series bets to be played. For example, the EGM 1 may display a standard game screen 11, e.g. a set of slot reels, cards or the like, and may additionally display a series bet selection box 12 on the display 6, and may include a button or buttons 8 that allow a player to initiate a series bet and/or to be taken to a screen that allows for the selection of a series bet from a number of possible series bets. For example, an odds look-up table may be called up from the memory 3 and displayed on the display 6 to show the possible series bets available and the associated odds/returns. Players may then select desired bets using appropriate touchscreen buttons or the like. The player may also select the amount to be bet upon a series bet, or this may be set automatically by the apparatus.

The game events that are monitored and bet on may include any event that might occur during a game. It may for example be a prize event and/or a feature or bonus event, e.g. of the types discussed above. It may for example relate to the winning of a prize in the play of the basic game. It may also for example relate to the occurrence of a valuable symbol, such as a wild symbol, e.g. a slot reel symbol or card, or to the changing of a game's parameters to provide a higher return, e.g. through better odds or through an increase in prize amounts. It could also be a free game, a respin or the actuation of a feature game that provides these or other advantages, e.g. a jackpot spin.

The series bet may relate to the number of times that a game event occurs during the series of game plays, e.g. a bet may be made that an event will occur a set number of times or a minimum or maximum number of times or within a range of times. It may also relate to the accumulated value of game events that occur in the bet upon period, e.g. winning more or less than a set amount.

The series bet may relate to a combination of different types of monitored game event occurring over a series of game plays. It may for example relate to the occurrence of one event a first number of times and another event a second number of times.

The series bet may be played over any number of game plays. The number may be set by the gaming apparatus or may be set manually by the player. It may for example be a series of 4, 5 or 6 game plays, and could be more or less.

The basic games that are played in a series of games may be identical or may include a number of different games, and could include games played on a number of different machines. The latter could for example occur in systems that allow for player information to be transferred between machines, e.g. using a player identification card or a central control that can track and store player information.

A player may be automatically eligible to place a series bet, e.g. based upon gameplay in the basic game, e.g. through a series bet trigger, e.g. if a minimum amount is bet or the like. The series bet feature may alternatively require the placing of a side or secondary bet. The playing of the series betting feature may be optional or may be compulsory.

The apparatus may include means for fixing or limiting the play parameters of the basic game or games when a series bet is placed. This may be needed to ensure that the game is mathematically viable and consistent when it includes the series bet feature. For example, the playing of a series game may require a fixed bet on the underlying basic games that are played in the series.

The series bet win event may be of any suitable type, and, e.g. may be a prize amount. The prize amount may be fixed or may depend upon the amount placed on the series bet. The series bet win event may be a jackpot event, e.g. the winning of a jackpot or the winning of the chance to play a jackpot, e.g. a jackpot spin. It could also relate to the winning of a game feature, such as triple winnings for a set number of games or the like.

The plays of the game are concurrent, so that a player plays a number of games at the same time. Thus, six sets of slot reels may be provided on a gaming machine's display at the same time, and may all be spun together In this case, a player will win on each game separately as usual, and will also win based on the combination of events across all of the reel sets.

The EGM 1 may play a linked jackpot with other machines, in which case the reward for winning a series bet could be the winning of the linked jackpot. Also, with linked machines, a series bet may relate to concurrent play on a number of machines, e.g. a player may bet on the occurrence of game events over one or a number of plays on a number of machines. A player may bet on the occurrence of game events during their own play and during the plays of others, e.g. during the next play or set of plays that everyone or a subset of other players makes.

Figure 2:
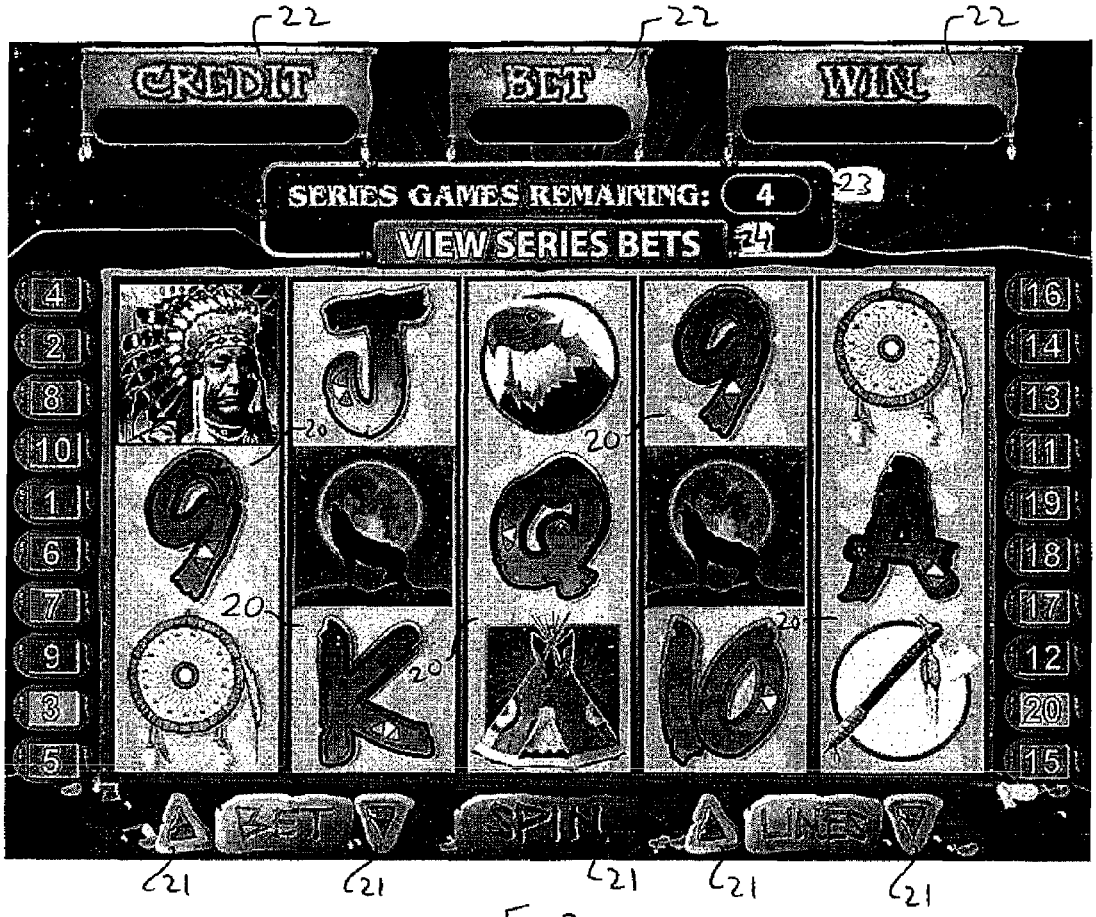
FIG. 2 is a screen shot of a gaming machine's display, showing series betting features, according to an embodiment of the present invention.

FIG. 2 is a screen shot of a display 6 showing one implementation of a series betting feature.

The screen shot shows a number of virtual gaming reels 20 that are spun to provide symbol combinations in accordance with the rules of the gaming algorithms run by the controller 2 and its random number generators. It also shows touchscreen buttons 21 that allow a user to place a bet, to choose the number of pay lines to play (numbered along the left and right sides of the reels 20), and to set the reels 20 spinning. It further shows indicator boxes 22 for indicating a player's remaining credits, the bets laid and a player's accumulated winnings.

Above the reels 20 is an information window 23 that indicates the number of plays of the game remaining in the bet series, in this case four are remaining from the required number of plays, e.g. a series of six plays. Also shown is a touchscreen button 24 for viewing a list of series bets that may be or have been placed. Thus, if the touchscreen button 24 is pressed, a window may appear with a list of series bets that may be made, and with an indication of which ones have been made. A user can then select the series bets that they wish to play and may also select the amount to bet on each series bet selected. During a series of plays of a game, a player may refresh their memory on the series bets that have been made by pressing the button 24 to view the series bets window or screen. This window or screen may also show the results so far achieved in previous plays of a current series bet.

For example, the pressing of the button 24 may reveal an "odds" table such as:

| | |
|---|---|
| Win on all 6 games | Pays 1000-1 |
| Win on 5 games (only) | Pays 200-1 |
| Win on 4 games (only) | Pays 30-1 |
| No wins will occur | Pays 20-1 |
| Features trigger on all 6 games | Pays Major jackpot |
| Features trigger on 5 games only | Pays Minor jackpot |

A player may bet a fixed amount or a variable amount on each series bet, and may bet on one or more of the series bets.

Once a player has placed their series bets, they may play the slot reels 20 for the full series of plays, e.g. for six concurrent plays. The results of each play are monitored by the EGM 1, and may be viewed at any time, e.g. through the "View Series Bets" button 24.

During plays of the reels 20, the player wins prizes as usual, but at the end of the series of plays, the player is also rewarded based on the events that occurred during the various plays in the series and on the player's series bet selections and bet amounts.

Figure 3:
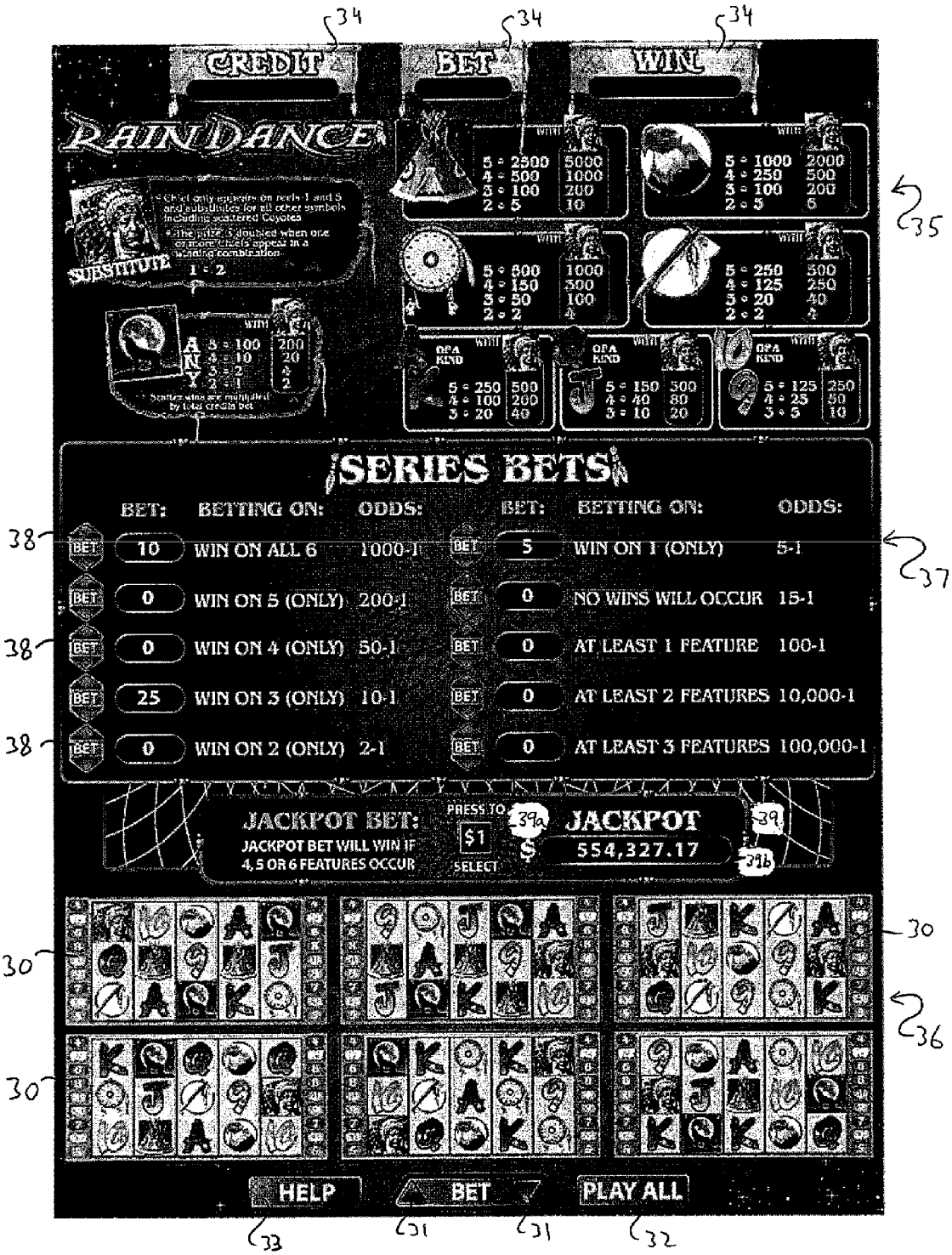
FIG. 3 is a screen shot of a gaming machine's display, showing series betting features according to another embodiment of the present invention.

FIG. 3 is a screen shot of a display 6 showing another implementation of series play betting. In this example, six slot reel games 30 are played concurrently.

Thus, a player will use the bet buttons 31 to place a bet on each of the reel sets 30, e.g. at a set number of pay lines for each reel set, and will press the "play all" button 32 to play all of the reel sets together. A help button 33 can be pressed to obtain instructions and the like, whilst indicator windows 34 display a player's remaining credits, the total bet so far laid, and a player's accumulated winnings.

A screen area 35 displays winning combinations and the like, whilst a screen area 36 displays the six reel sets 30, and a screen area 37 displays series bets that may be selected. A player chooses the series bets to play by indicating a betting amount using the bet up/down buttons 38 in the screen area 37, with a bet of zero equating to no selection of the associated series bet.

In a further manner of selecting a series bet, the screen in FIG. 3 also displays a jackpot bet window 39 with a button 39*a* that may be pressed in order to select a fixed $1 side bet, such that if 4, 5 or 6 features occur, a jackpot will be won.

The monitored features may be of any type, so that any type of feature triggered will contribute to the feature event count. They could also be of a particular type, so that for example only features relating to a wild symbol will be counted in the series bet.

The jackpot may be a progressive jackpot with the current jackpot amount shown in window 39*b*. It may be part of a linked jackpot, which may be won by a number of different machines.

As well as winning across the reel sets, a user can win on each reel set independently, as usual.

Figure 4:
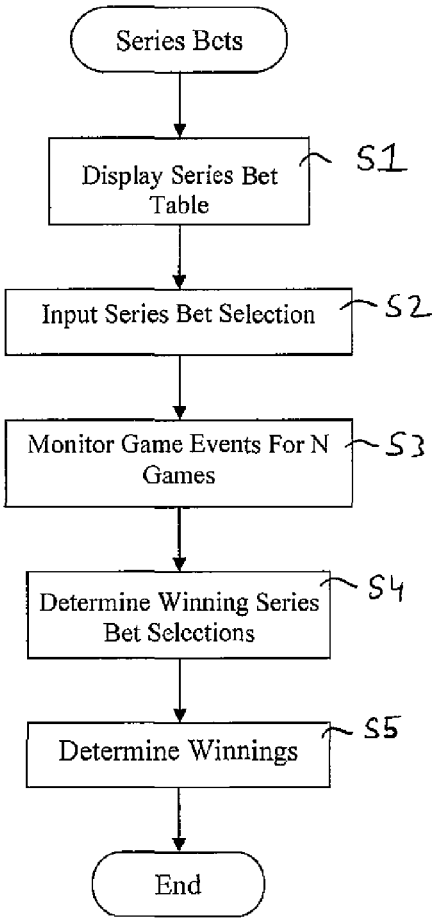
FIG. 4 is a flow diagram of a control process in accordance with an embodiment of the present invention.

FIG. 4 shows one possible flowchart for the provision of a series betting feature. Thus, an embodiment of the invention may be put into effect by the controller 2 and/or central control 9 running software that incorporates a subroutine executing in the manner shown. The method can therefore be put into effect by providing a suitable software product, e.g. a recording medium on which the software is provided, where the software has components for carrying out the various actions required by the method.

The series betting routine is entered at step S1 when for example a player activates a series betting button 8 on a machine's display 6. Thus, in step S1 a Series Betting Table is displayed, which may for example list the different possible series bets that are available and may include a betting button adjacent each possible series bet, so that at step S2, the apparatus can monitor for the pressing of betting buttons to determine which series bets are to be placed and the bet amount for each series bet selected. In step S3, the apparatus monitors the relevant game events that occur during a subsequent series of concurrent game plays, e.g. for the next N plays of the game, e.g. six plays. Once the appropriate number of games has been played, the apparatus determines at step S4 whether any of the series bets were winning bets based on the recorded/monitored events, and, in step S5, the apparatus determines any winnings for the player based on the bet amounts placed on the winning series bets.

The above of course is only one possible routine and other steps and routines may be utilised as well.

Figure 5:
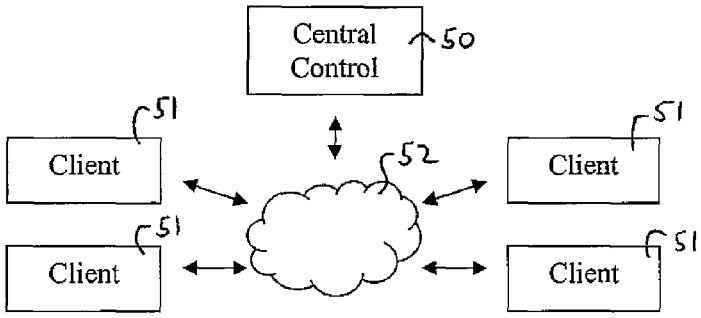
FIG. 5 is a schematic diagram of further apparatus for implementing an embodiment of the present invention.

FIG. 5 is a schematic diagram of further apparatus for carrying out an embodiment of the present invention, in which there is a central control/server 50 that communicates with a number of remote player terminals/client programs 51, e.g. computing devices, through a suitable communications medium 52, e.g. the Internet or an Intranet. The computing devices 51 could for example be personal computers, PDAs, mobile phones, digital televisions or the like, and the communications medium 52 could be e.g. the Internet, an intranet, a telephone or television communications system, e.g. satellite or cable, or any other suitable communications network.

In this embodiment, the running of a game and the determining of bet outcomes and the like, including the provision of series bet features, can occur on the central control 50, whilst user inputs and the display of games screens and the like occur on the player terminals 51. The terminals 51 may receive program code or other data from the central control 50 in order to provide an appropriate user interface.

Figure 6:
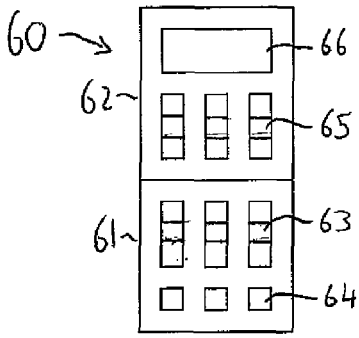
FIG. 6 is a schematic diagram of further apparatus for implementing an embodiment of the present invention.

FIG. 6 shows further apparatus that could implement an embodiment of the present invention, in which an electronic gaming machine 60 includes a mechanical part 61 and an associated electronic control and display 62. The mechanical part 61 includes a set of mechanical reels 63 and player buttons 64, with the reels 63 being spun and stopped to provide prizes and features based on the resulting reel symbols. The electronic control 62 may display the results of the reels 63, e.g. as screen reels 65, and may also oversee any feature functions and the like associated with the game, such as a series betting feature, through further display area 66.

As can be seen, the gaming apparatus may take many different forms, including an EGM and/or computing network. It could for example comprise a game provided on a computing or other electronic device, such as on a personal computer, PDA, mobile phone, digital television, or the like. The game may be provided over an intranet, the Internet, or some other communications system, such as a mobile telephone system.

The game or games played may take any suitable form. They could be e.g. a slot machine type game or a casino-type game. They could be e.g. poker, keno, bingo, Sic-Bo, pachinko, blackjack, roulette or any other suitable game. The series of game plays bet upon may include a combination of such games.

It is to be understood that various alterations, additions and/or modifications may be made to the parts previously described without departing from the ambit of the present invention, and that, in the light of the above teachings, the present invention may be implemented in mechanical elements, in software, in firmware and/or in hardware in a variety of manners as would be understood by a person skilled in the art.

The invention claimed is:

1. Gaming apparatus including:

game means for allowing a number of games to be played simultaneously, including means for placing bets on each of the games and for determining win outcomes based on the playing of each of the games;

monitoring means for monitoring the occurrence of one or more game events during a series of concurrent game plays;

series betting means for allowing a user to place a series bet on the occurrence of one or more game events over said series of concurrent game plays, said series betting means being operable by the user independently of operation by the user of said means for placing bets on each of the games; and series win means for determining a series win event based on a placed series bet and on the occurrence of said one or more game events.

2. The apparatus of claim 1, wherein said monitored game events include prize events.

3. The apparatus of claim 1, wherein said monitored game events include feature events.

4. The apparatus of claim 1, wherein said series bet relates to the number of game events that occur over the series of concurrent game plays.

5. The apparatus of claim 1, wherein said series bet relates to a combination of game events that occurs over the series of concurrent game plays.

6. The apparatus of claim 1, wherein said series win event is a prize event.

7. The apparatus of claim 1, wherein said series win event is a jackpot event.

8. The apparatus of claim 1, wherein said series win event is a feature event.

9. The apparatus of claim 1, wherein said series betting means allows a player to set a bet amount for a series bet.

10. The apparatus of claim 1, wherein said apparatus includes an odds look-up table that lists series bets available and their odds.

11. The apparatus of claim 1, wherein said series betting means includes selection means for allowing a user to select one or more series bets from a predetermined set of series bets.

12. The apparatus of claim 11, wherein said selection means includes a table of possible series bets including odds for determining returns on the bets, means for displaying the possible series bets, and means for allowing a user to select the series bets on which they wish to bet and to set the bet amount for each series bet selected.

13. The apparatus of claim 1, wherein said apparatus includes means for fixing or limiting player betting parameters in the played games when a series bet is placed.

14. The apparatus of claim 1, wherein the series betting means includes means for selecting a fixed series bet at a fixed bet amount.

15. The apparatus of claim 1, wherein the apparatus is an electronic gaming machine.

16. The apparatus of claim 1, wherein the apparatus includes a central control and a plurality of remote player devices in communication with the central control.

17. The apparatus of claim 1, wherein the apparatus includes a network of electronic devices.

18. A gaming system including:

game means for allowing a number of games to be played simultaneously, including means for placing bets on each of the games and for determining win outcomes based on the playing of each of the games;

monitoring means for monitoring the occurrence of one or more game events during a series of concurrent game plays;

series betting means for allowing a user to place a series bet on the occurrence of one or more game events over said series of concurrent game plays, said series betting means being operable by the user independently of operation by the user of said means for placing bets on each of the games; and series win means for determining a series win event based on a placed series bet and on the occurrence of said one or more game events.

19. The system of claim 18, wherein the system includes a central control for running a gaming algorithm, and a plurality of remote clients in communication with the central control over a communications network, the remote clients including screens for displaying gaming screens and inputs for allowing player interaction with the central control.

20. A method of operating gaming apparatus, the method including the steps of:

providing a gaming apparatus capable of monitoring game events of concurrent game plays on said gaming apparatus;

running a number of games simultaneously on said apparatus while inputting a bet relating to each of the games into said gaming apparatus;

using said gaming apparatus to monitor the occurrence of one or more game events during a series of concurrent game plays;

allowing a user to input into said gaming apparatus, a series bet on the occurrence of one or more game event over said series of concurrent game plays, the inputting by the user of said series bet being independent of the inputting by the user of said bet relating to each of the games; and using a calculating capability of said gaming apparatus to determine a series win event based on a placed series bet and on the occurrence of said one or more game events.

21. Gaming software including:

a non-transitory recording medium on which software is recorded, said software including:

a play component for allowing a number of games to be played simultaneously, including for placing a bet on each of the games and for determining win outcomes based on the playing of each of the games;

a monitoring component for monitoring the occurrence of one or more game events during a series of concurrent game plays;

a series bet component for allowing a user to place a series bet on the occurrence of one or more game events over said series of concurrent game plays, wherein the placing by the user of said series bet is independent of the placing by the user of said bet on each of the games; and a series win component for determining a series win event based on a placed series bet and on the occurrence of said one or more game events.

22. Gaming apparatus including: a gaming device for running a number of games simultaneously and receiving bets relating to each of the games; an event monitor for monitoring the occurrence of a game event over a number of concurrent game plays; and a series bet selector for allowing a user to select a series bet relating to the occurrence of at least one game event over a number of concurrent game plays, wherein said series bet selector is operable by the user independently of the placement by the user of the bets relating to each of the games.

23. Gaming apparatus including:

slot game means for allowing a number of slot games to be played simultaneously, including means for placing bets on each of the slot games and for determining win outcomes based on the playing of each of the slot games;

monitoring means for monitoring the occurrence of one or more game events during a series of concurrent slot game plays;

series betting means for allowing a user to place a series bet on the occurrence of one or more game events over said series of concurrent slot game plays, wherein the placing by the user of said series bet is independent of the placing by the user of said bet on each of the slot games; and series win means for determining a series win event based on a placed series bet and on the occurrence of said one or more slot game events.

24. Gaming apparatus according to claim 23 wherein the series betting means allows the user to place a series bet on the occurrence of a win on all of the concurrent slot game plays.

25. Gaming apparatus according to claim 23 wherein the series betting means allows the user to place a series bet on the occurrence of a win on a predefined number of the concurrent slot game plays and wherein the predefined number is less than the number of concurrent slot game plays.

26. Gaming apparatus according to claim 23 wherein the series betting means allows the user to place a series bet on the occurrence of no wins on any of the concurrent slot game plays.

27. Gaming apparatus according to claim 23 wherein each of the slot games is capable of triggering a feature event and wherein the series betting means allows the user to place a series bet on the triggering of a feature event on all of the concurrent slot game plays.

28. Gaming apparatus according to claim 23 wherein each of the slot games is capable of triggering a feature event and wherein the series betting means allows the user to place a series bet on the triggering of a feature event on a predefined number of the concurrent slot game plays, the predefined number being less than the number of concurrent slot game plays.

* * * * *